United States Patent [19]

Felkel

[11] 4,131,759

[45] Dec. 26, 1978

[54] SLIP SLEEVE MECHANISM FOR A STRENGTH TAPERED CAGED ARMORED ELECTROMECHANICAL CABLE

[75] Inventor: Edward M. Felkel, Worcester, Mass.

[73] Assignee: United States Steel Corporation, Pittsburgh, Pa.

[21] Appl. No.: 823,252

[22] Filed: Aug. 10, 1977

[51] Int. Cl.[2] ..... H01B 17/22

[52] U.S. Cl. ..... 174/107; 174/108; 174/128 R; 174/131 A; 138/130; 57/216; 156/56

[58] Field of Search ..... 174/105 R, 107, 108, 174/109, 128 R, 130, 131 R, 131 A; 138/130, 133; 57/139, 144, 142, 147, 148; 156/51, 52, 56

[56] References Cited

U.S. PATENT DOCUMENTS

| | | | |
|---|---|---|---|
| 475,384 | 5/1892 | Cockburn | 138/130 |
| 1,786,936 | 12/1930 | Craig | 57/147 |
| 1,919,509 | 7/1933 | Grobl | 174/128 R |
| 2,463,590 | 5/1949 | Arutunoff | 174/128 R |
| 2,604,509 | 7/1952 | Blanchard | 57/147 |
| 3,367,102 | 2/1968 | Meger | 57/142 |

*Primary Examiner*—Elliot A. Goldberg
*Assistant Examiner*—John H. Bouchard
*Attorney, Agent, or Firm*—William A. Danchuk

[57] ABSTRACT

A multiple caged armored electromechanical cable is provided which is characterized in being torque balanced and strength tapered throughout its entire length. The selective strength tapering of the cable permits the orientation of the cable such that the strongest portion thereof will support the entire cable and the weakest portion thereof will support only itself and whatever instrumentation is desirable. A slip sleeve mechanism is provided for retaining portions of the strength tapered elements of the cable to prevent inadvertant electrical shorting as well as providing for a relative slippage of the tapered strength elements with respect to select other elements of the cable.

10 Claims, 5 Drawing Figures

SLIP SLEEVE MECHANISM FOR A STRENGTH TAPERED CAGED ARMORED ELECTROMECHANICAL CABLE

BACKGROUND OF THE INVENTION

Currently available electromechanical cables are configured having a strength member external to the electrical conductors which is formed by helically winding a plurality of metal wires about the central electrical core, the helically wound wires covering approximately 95–98% of the outer surface of the electrical core. In order to achieve a torque balance and increase strength, two or more of these armored wire layers are sequentially laid over the electrical core. Attempts have been made to form the helical layers in directions opposite each other so as to achieve torsional balance of the entire cable. Usually this contrahelical construction is limited to two layers only, whereupon the outer layer having the larger moment arm and total material cross section generally has the dominating torque and torsional unbalance is caused to exist. A torque unbalance in an electromechanical cable, especially one which is suspended in water, is undesirable because it causes an angular twist in the cable around the cable axis which progresses as tension is applied to the cable by any means when the one cable end is allowed to rotate. A cable having this twisting tendency is subject to damage by various means including kinking and birdcaging which results when the restorative torsional energy of the long length of a cable is released over a relatively short length of the same cable. This local tensional energy release causes a sudden return rotation of the cable which loosens one layer of armor (usually the outer layer) of a contrahelically or double layer armored cable. This loosening causes the armor wires to locally form into a much extended diameter which results in a phenomenon referred to as a birdcage. With regard to kinking, the stored rotational energy within the cable causes several local cable rotations so that cable loops or coils result. Any subsequent tensioning of the cable without prior reverse rotation will result in tightening of the loop with consequent damage to the armor wires and/or the electrical cord.

Another major problem relating to currently manufactured electromechanical cables, with which the present invention is directed, is cable weight. Specifically, available armored electromechanical cables are fully armored throughout their entire length. As a result, that portion of the cable (usually the top portion of the cable) which supports the remainder of the cable has to support a fully weighted cable throughout its entire length. The strength inherent within the fully armored cable proximate the lower end of the cable (assuming the cable is hung vertically in water) has an inherent strength which is far in excess of that necessary for the support and electrical conductance of relatively light instruments. As a result, the final cable produced is usually of a size and strength which far exceeds, at least at its lower end, the strength necessary for supporting the cable at its lower end.

Another problem associated with currently available electromechanical cables is a limitation of the flexure life of the cable when the assemblage is traversed over a circular surface while the cable is held under tension. Such circular surfaces may include those on sheaves, capstans, winches and the like. Flexure life for currently produced contrahelically armored cables is limited to a value below 50,000 flexure cycles and more generally below 20,000 flexure cycles. Cable flexure life is limited because of the rapid wear of the metallic surfaces of the wires in adjacent armored layers which is caused by the very high compressive forces and poor lubricity. The flexure life will decrease as the ratio of the diameter of bend of the electromechanical cable to the diameter of the largest wire in the strength member assemblage decreases. This ratio in current art is above the value of 400.

SUMMARY OF THE INVENTION

The present invention is addressed to an electromechanical cable construction which provides for the forming of wires in all armored layers in a manner which results in the development of a radial space between all wires and their adjacent counterparts. Once obtained, this spacing is maintained by a retention element or by filling the voids with a curable semi-liquid material which is subsequently hardened. This covering is made to cover the external wires so that no individual wire is exposed to the environment. In a preferred embodiment of the invention, the electromechanical cable construction utilizes two tapered strength armored layers as described above and is referred to throughout this specification as a double caged tapered strength armored cable.

The advantages of the double caged armored electromechanical cable are numerous. These advantages are multiplied with the introduction of a tapered strength configuration incorporating the slip sleeve mechanism to the double caged armored electromechanical cable. In particular, throughout progressive sublengths of the entire cable's length, individual wires in each of the armored layers are progressively dropped (or added), thereby resulting in a cable having greater strength at one end progressing to the other end at which minimal strength is provided. The slip sleeve mechanism provides for a cable which permits for the inclusion or deletion, at select points along its length, of extra wires for the strength tapering of the cable while preventing accidental shorting of the cable by the extra wires contacting the cable's electrical core. It should be obvious that a cable of this variety may be supported at its increased strength end and held within a water or air environment in a vertical manner with the decreased strength end supporting the instrumentation connected to the electrically conductive core. The low weight of an electromechanical cable in a fluid such as water is extremely important in order to minimize the cable weight necessary to support itself and the attached load while withstanding drag or other externally imposed forces.

Another advantage of the double caged armored electromechanical cable of the present invention resides in the area of increased flexure life because the mechanism of this failure mode is eliminated. Specifically, the armored wires within the present invention contained within a single armored layer do not abrade on each other because of their separation. Testing in this area has indicated at least a doubling of flexure life.

Another feature to be gained from the double caged armored electromechanical cable of the present invention has to do with the problem of torque balancing such a cable. Torque balancing can be conveniently handled by proper design of the outer armored layer relative to the inner armored layer. Due to the spacing of the wires in each of the layers, the space between the wires in the outer armored layer (assuming equal size wires) can be made larger so that the moment in the outer armored layer is made equal to the moment of the inner armored layer. This result is affected by the fact that the moment within any one layer is the product of the pitch radius of the wires in the armored layer times the circumferential forces exerted by the plurality of wires in that layer as tension is applied to the electromechanical cable. The armored technique in this invention permits the strength variance of the cable along its length by stopping some of the individual armored wires at predetermined points along the cable length during the armoring process. By this means, the number of armored wires in any layer at particular cross sections along the cable is varied to conform to the tensile strength requirements for that particular point. Additionally, by varying both the inner and outer wired armored layer simultaneously, tapered strength as well as torque balancing may be effected throughout the entire length of the electromechanical cable according to the present invention.

Accordingly, it is a primary feature and object of the present invention to provide a caged armored cable which is strength tapered throughout its entire length and which includes a slip sleeve mechanism for preventing accidental shorting of such a cable.

Another general object and feature of the present invention is to provide a double caged tapered strength armored electromechanical cable of a given length having first and second armored layers formed from oppositely wound helically shaped first and second pluralities of wires, respectively, each of the first and second pluralities of wires having a given numerical quantity for a given sublength of the whole cable length, the given numerical quantities being changed together progressively for progressive other given sublengths of the whole cable length for producing a tapered strength caged armored electromechanical cable, the cable including slip sleeves at the numerical change points of wires within the cable.

Still another object and feature of the present invention is to provide a double caged tapered strength armored electromechanical cable of a given length having first and second armored layers formed from oppositely wound helically shaped first and second pluralities of wires, respectively, each of the first and second pluralities of wires having a given numerical quantity for a given sublength of the whole cable length, the given numerical quantities being changed together progressively for progressive other given sublengths of the whole cable length for producing a tapered strength caged armored electromechanical cable, the electromechanical cable having slip sleeves at the termination points of the wires within each layer for protecting the cable from shorting and also for permitting slight movement of the wire ends within such slip sleeves thereby preventing binding, birdcaging or the like.

Other objects and features of the present invention will, in part, be obvious and will, in part, become apparent as the following description proceeds.

The invention accordingly comprises the apparatus and method possessing the construction, combination of elements, steps, usage levels and arrangements of parts which are exemplified in the following detailed description and the scope of the application which will be indicated in the claims.

BRIEF DESCRIPTION OF THE DRAWINGS

The novel features that are considered characteristic of the invention are set forth with particularity in the annexed claims. The invention itself, however, both as to its structure and its operation, together with additional objects and advantages thereof, will be best understood from the following description of the preferred embodiment of the invention when read in conjunction with the accompanying drawings wherein

DETAILED DESCRIPTION OF THE INVENTION

Figure 1:
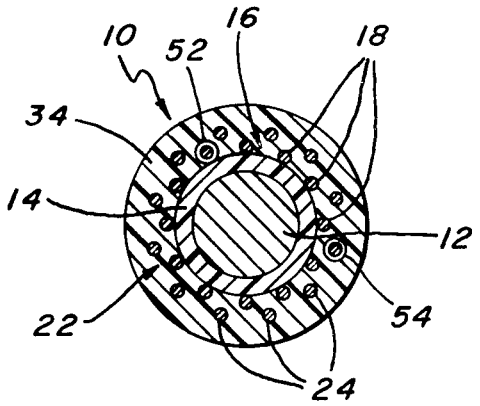
FIG. 1 is a cross-sectional view of one portion of the electromechanical cable according to the present invention taken through a slip sleeve along a given portion of the cable.
Figure 2:
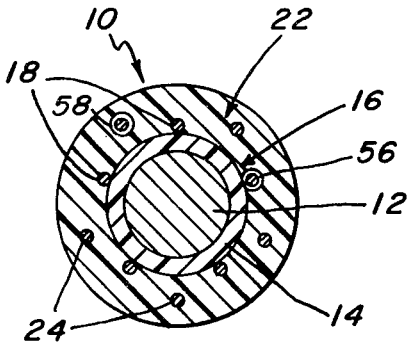
FIG. 2 is a cross-sectional view of the electromechanical cable according to the present invention taken through a slip sleeve along yet another portion of the double caged tapered strength armored cable.
Figure 3:
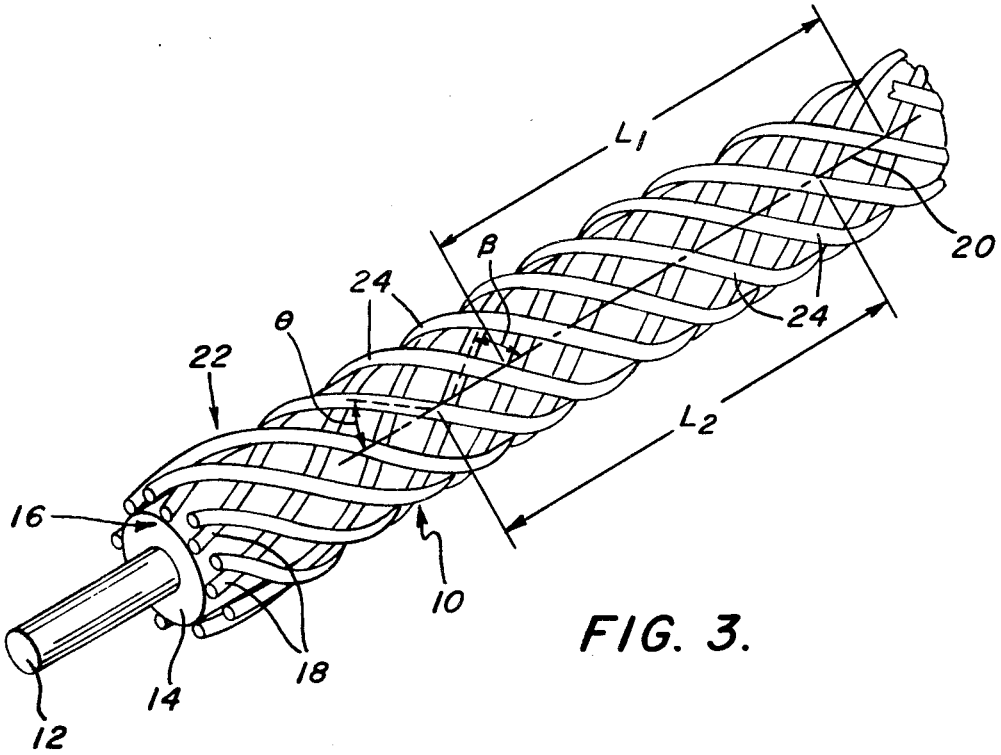
FIG. 3 is a perspective view of the electromechanical cable according to the present invention with portions broken away to reveal internal structure.

Looking to FIGS. 1–3, there is shown both a perspective as well as cross-sectional views of an electromechanical cable generally indicated at 10. The electromechanical cable 10 may be of any length or diameter required for the specific uses to which such a cable would be subjected. Located within the center of the electromechanical cable 10 is a core 12. The core 12 may take on any one of a number of configurations, however, in the preferred embodiment of the present invention, the core 12 is an electrically conductive element running the full length of the cable. The electrically conductive cord 12 may be of a single strand or multiple strand configuration. Once again, in the preferred embodiment of the present invention, the electrical core is made up of a series of small wires wound together throughout the entire length of the electromechanical cable 10. Positioned about the periphery of the electrical core 12 is an insulative coating or member 14 which may take any one of a number of known configurations within the prior art. The insulative member 14 not only insulates the electrical core 12 but partially protects the electrical core from shorting by the armored caged layers located thereabove.

Provided about the circumference of the insulative material 14 is a first armored caged layer 16. The armored caged layer 16 is formed from a plurality of single wires 18. The wires 18 are positioned directly upon the insulative material 14 and are helically wound thereabout as shown in FIG. 3. Each of the wires 18 comprising the first layer 16 are wound at an angle beta with respect to the longitudinal axis 20 of the cable. One other way of gauging the helical winding of the layer is by determining the lay length of one single wire within the layer. The lay length $L_1$ is the distance that a single wire measured from a given point upon the insulative base takes to return to that given position down the cable. The greater the lay length $L_1$ the smaller the angle beta. It should be noted that the plurality of wires 18 within the first caged armored layer are separated from each other and do not abut adjacent wires located within that layer. As previously noted, this is important in order to obviate the binding and abrading of the armored wires on each other as happens in fully armored cables. Additional advantages and features of the caged armored cable layering will be discussed in further detail below.

Positioned upon the first armored layer 16 is a second armored layer 22. As noted within FIG. 3, the helically wound layer 22, formed from the plurality of wires 24 is wound in an opposite helical winding from the first caged armored layer. This contrahelical winding can best be seen by referring to FIG. 3. The individual wires forming the second armored layer 22 are all orientated at an angle alpha with respect to the longitudinal axis 20 of the cable 10. It should be noted that alpha does not necessarily have to equal the angle beta previously with respect to the first armored layer. However, for purposes of simplification and brevity, it is assumed, unless noted otherwise, that the angle alpha is approximately equal to the angle beta. In a manner similar to the first layer, the wires of the second layer 22 may also be referred to (in a helical sense) as having a lay length $L_2$ also defined as the required length of a single wire to return to the same relative position along the longitudinal axis of the cable. Again, for purposes of simplicity and brevity, it is assumed that $L_1$ or the lay length of the wires forming the first armored layer is substantially equal to the lay length $L_2$ of the second or outer caged armored layer. The possible variation of alpha and beta as well as $L_1$ and $L_2$ will be discussed in further detail below.

The important features and advantages of caged armored cable have been discussed. It is important to further note the advantages of a tapered strength double caged armored cable and in this regard reference should be made to FIGS. 1, 2 and 4. The tapered strength features of the electromechanical cable 10 are effected by the introduction (at given points along the cable's length) of additional wires in each of the two armored caged wire layers 16 and 22. The added wires are placed within the spaces provided between adjacent wires in each layer and are usually, although not necessarily, simultaneously provided to both the first layer 16 and the second layer 22. The points at which the number of wires in each layer are progressively increased or decreased (depending upon which end of the cable is used as a basis) are dictated by the cable requirements and strength for the particular purpose to which the cable will be employed. The following graph is indicative of one cable embodiment showing the changes in wire numbers per each layer and the relative strength of such sublengths of the entire cable.

EXHIBIT A

| A | B | C | D | E | F | G | H | I | J |
|---|---|---|---|---|---|---|---|---|---|
| Section | Net Wgt. per 1,000' ea. Section pounds | Total wires | Section B/S pounds | Yield Strength (78% B/S) pounds | Section Length Feet | Safety Factor Length Feet | Total Weight of (G) pounds | Safety Factor | Total Length Through Section |
| #1 | 479.78 | 14 × 14 | 26,677 | 20,808 | 13,000 | 13,000 | 6,237.14 | 3.336 | 13,000 |
| #2 | 507.26 | 15 × 15 | 28,582 | 22,294 | 1,000 | 14,000 | 6,744.40 | 3.305 | 14,000 |
| #3 | 534.74 | 16 × 16 | 30,488 | 23,780 | 1,000 | 15,000 | 7,279.14 | 3.266 | 15,000 |
| #4 | 562.22 | 17 × 17 | 32,393 | 25,266 | 1,000 | 16,000 | 7,841.36 | 3.222 | 16,000 |
| #5 | 589.70 | 18 × 18 | 34,299 | 26,753 | 1,000 | 17,000 | 8,431.06 | 3.173 | 17,000 |
| #6 | 617.18 | 19 × 19 | 36,204 | 28,239 | 1,000 | 18,000 | 9,048.24 | 3.121 | 18,000 |
| #7 | 644.66 | 20 × 20 | 38,110 | 29,725 | 2,000 | 18,000 | 9,378.00 | 3.169 | 20,000 |
| #8 | 672.14 | 21 × 21 | 40,015 | 31.212 | 3,000 | 18,000 | 9,955.08 | 3.135 | 23,000 |
| #9 | 699.62 | 22 × 22 | 41,921 | 32,698 | 2,500 | 18,000 | 10,504.68 | 3.112 | 25,500 |
| #10 | 727.10 | 23 × 23 | 43,826 | 34,184 | 2,000 | 18,000 | 10,999.32 | 3.108 | 27,500 |
| #11 | 754.58 | 24 × 24 | 45,732 | 35,670 | 1,500 | 18,000 | 11,411.52 | 29,000 | |

The progressive addition of wires in each of the layers throughout the entire length of the electromechanical cable 10 provides for a tapered strength of the entire cable due to the increased number of supportive wires in each of the layers. The cable may have one or two progressive increases of wire numbers throughout its length or may have several dozen progressive changes throughout its length. In all cases, however, wires are progressively added (or subtracted) as one progresses along the cable from one end to the other. This point is indicated in the graph noted above and may be seen as added wires 26 and 28 in FIG. 4.

The progressive addition or subtraction of wires within both the first and second armored layers for strength tapering purposes results in a plurality of wire ends which are loosely retained within their respective layers. Under ideal conditions such a situation would not present any major problems. However, due to the flexure of the cable, the small amount of rotation of the cable, even when torque balanced, and the general abuse a cable is subjected to, a problem is presented by these loose ends. Specifically these loose ends, several of which are shown at 26 and 28 in FIG. 4 may, under certain circumstances, find their way through the armored layers and the insulation 14 and short the electrical core 12. Inasmuch as the subject cable is relatively difficult to manufacture, as well as expensive, such as a possibility, however remote, must be obviated in order to protect the investment in both time and money. Consequently, the slip sleeve mechanism of the present invention has been formulated.

In short, the slip sleeve according to the present invention is a section of protective metal or hard plastic tubing into which is placed the wire end. The tubing may or may not be secured to the adjacent wires by spot welding, soldering or glueing or by any other conventional means. The tubing, if long enough will be held secure by successive armored layers. In the preferred embodiment of the present invention, however, the tubing is manufactured from a short length of a small diameter piece of metal tubing. The tubing diameter is, in the most ideal conditions, slightly larger than the wire diameter for just accommodating the wire end. Also, in the preferred embodiment, the tubing or slip sleeve is spot welded or soldered to the two adjacent wires in the layer which have not been terminated for strength tapering purposes. While other slip sleeves are attached to the two adjacent wires at the terminus of the wire with which it is associated, the slip sleeve is only related to the wire terminus insofar as it supports the wire end movably therewithin and prevents the wire end from moving out of the layer with which it is associated. Thus, the tubing prevents accidental shorting of the cable or movement of wire ends out of the protective outer covering, thereby damaging and possibly ruining the cable altogether.

The number of such slip sleeves or tubing elements will be equal in number to the total free wire ends located within all layers of the entire cable. As the strength tapered cable is manufactured, wires are automatically added (or subtracted). The slip sleeves are automatically fed into the manufacturing machine (not shown) for incorporation within the cable. Alternatively, this operation (the slip sleeve introduction), as well as the spot welding or soldering, may be accomplished manually. It should be obvious that the automatic would be much more desirable than the manual.

The difference in diameter between the slip sleeve and the wires in the layer in which such sleeve is placed is ideally small. Any minor disparity may be easily accommodated by the outer covering. Accordingly, within limit such diameter differences may be easily handled.

Looking to FIGS. 1 and 2, it is apparent that FIG. 1 represents a cross-sectional view through the cable 10 at one of its high strength sublengths. The sectional view has also been taken through both an inner slip sleeve 52 and an outer slip sleeve 54. It is also apparent that FIG. 2 represents a cross section of the cable 10 taken at a lower strength or lesser strength sublength of the cable 10. Note the two additional slip sleeves 56 and 58. Consequently, it should be obvious that the sublength shown in FIG. 1 will support a greater physical load than the sublength indicated in FIG. 2 without the breaking of the individual wires in each of the layers or the wires forming the electrical core. In no case, however, do the individual wires in any layer contact the adjacent wires in the same layer. This provides for the advantage noted above related to flexure life. Currently available contrahelically armored cables have a flexure life which decreases due to the rapid wear of the metallic surfaces of the wires in any one layer rubbing against the adjacent wires in the same layer. The lower flexure life problem is eased due to the elimination of this failure mode. That is, the armored cables in any one layer do not abrade on each other due to the separation of each of the wires from the adjacent wires. It is exactly this separation which is permitted by the wire retention elements of the present invention.

A further advantage to be realized from a cable having the attributes of the ones described above is the availability of designing and manufacturing the cable to be torque balanced throughout its entire length, whether the cable is strength tapered or not.

The current problem in constructing electromechanical cables comprising strength members (armored wire layers) external to the electrical conducting core is to helically wind a plurality of metal wires in a manner which causes a torque balancing to the electrical cable as a whole. Inasmuch as priorly contrahelically wound electromechanical cables included strength members having a surface coverage of 95–98% of the electrical core, there resulted an unbalancing of torques due to a greater moment arm at the outer layer than the inner layer. Under a cable configuration having two armored layers, the outer layer has a larger moment arm and total armor material cross section than the inner layer. Consequently, the outer layer has a dominating torque and an unbalancing is caused to exist.

To offset the effect of the larger moment arm in the outer armored layer, the size of the wires in the outer armored layer were made smaller than the wire size of the inner armored layer. This design approach was used to obtain torsional balance with the sacrifice of armor wire abrasion resistance, corrosion life, snag resistance and position stability when the entire assemblage of electrical conductors and armored layers are subjected to flexure. An unbalancing of torques in the electromechanical cable is undesirable because it causes an angular twisting in the cable around the cable axis which progresses as tension is applied to the cable by any means when one end is allowed to rotate. It should be noted in this regard that it is assumed for practical purposes that the electromechanical cable to be torque balanced is hung in a vertical manner with the greater strength sublengths at the top where the cable is supported as a whole and the lesser strength sublengths of the cable below. A cable having the twisting tendency noted above is subject to damage by various mechanisms including kinking and birdcaging which result when the restorative torsional energy of a long length of cable is released over a relatively short length of the same cable. This local torsional energy release causes a sudden return rotation of the cable which tends to loosen one layer of the armor (usually the outer armor of a contrahelically or double layered armored cable) thereby causing a loosening to the outer armored layer. Any subsequent tensioning of the cable may very well cause substantial damage to the outer armored layer and would certainly cause indirect damage insofar as abrasion and wearing of wires would be concerned. It is for this reason among others, that the slip sleeves are provided for permitting slight movement of the wire end within the sleeves.

Figure 4:
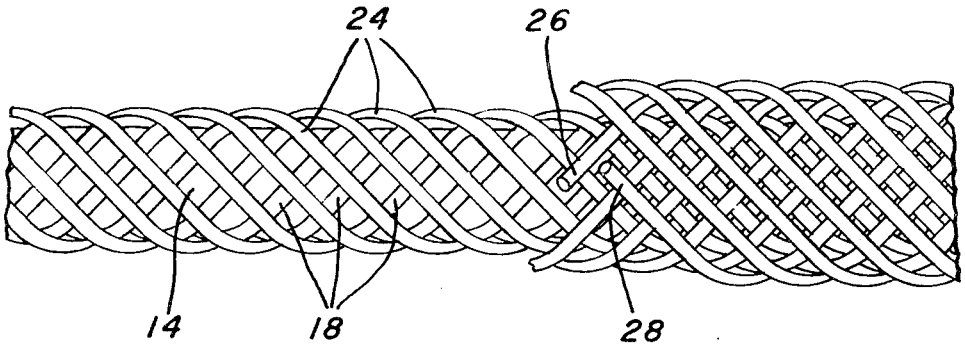
FIG. 4 is a side view of the electromechanical cable of the present invention showing the strength tapering features of the present cable.
Figure 5:
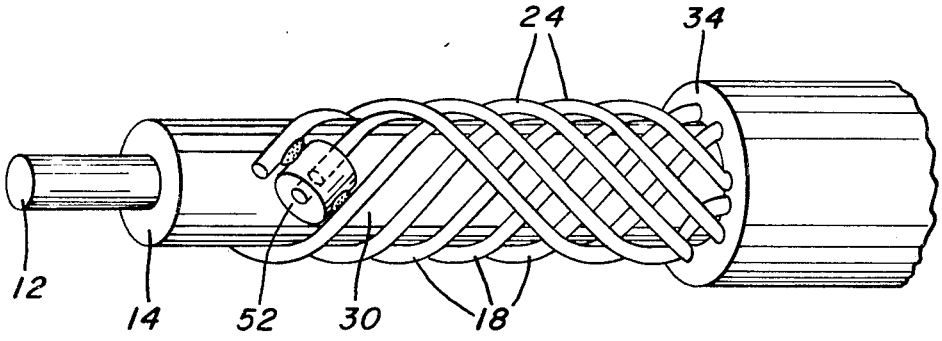
FIG. 5 is a progressive schematic view indicating the steps to be performed in the method for making the cable according to the present invention.

Looking to FIG. 5, there is shown in schematic form the individual steps to be performed in the manufacture of a tapered strength torque balanced electromechanical cable. As noted previously, the electrical core 12 is coated with a conventional insulative material 14. Next, a helical winding of wires having a spacing 30 therebetween is made upon the insulative material 14. Next, a second winding contrahelically wound to the first layer is made. If a progressive length of the electromechanical cable includes an extra wire which is added at a given point along its length, usual circumstances would dictate that another wire should be added to the outer cable. This is best seen in FIG. 4 as added wire 26 and 28. When these wires are added to the cable, there are slip sleeves placed on the wire ends and attached to the adjacent two wires. Finally, as the double layering has been completed, a thermoplastic material 34 is applied or extruded over the double armored caged layers and into the interstitial spaces formed therebetween. This thermoplastic material may take the form of thermoplastic rubber, high density polyethylenes, polyvinylchloride, polypropylene, etc. Additionally, the extrudable thermoplastic material may take the form of thermoplastic elastomeric materials. As noted previously, the thermoplastic material serves a double purpose of protecting the entire double caged armored cable and filling the interstitial spaces located therein so as to prevent relative movement of one wire in any given layer relative to another wire. In this general regard, an alternative embodiment for retaining the outer layer wires in a static position relative to the inner layer wires is described and claimed in a co-pending application for a U.S. patent entitled HELICALLY WOUND RE- TAINING MEMBER FOR A DOUBLE CAGED ARMORED ELECTROMECHANICAL CABLE, Ser. No. 823,250, by Edward M. Felkel, and filed simultaneously and assigned in common herewith. Additionally, the general make-up of a tapered strength torque balanced electromechanical cable with all its intracacies is described and claimed in another co-pending application for a U.S. patent by Edward M. Felkel, entitled DOUBLE CAGED ARMORED ELECTROMECHANICAL CABLE, Ser. No. 823,251, filed simultaneously herewith and assigned to the assignee to the present invention.

The tapered strength torque balanced multiple armored cable of the present invention is operative to provide a lighter and more efficient electromechanical cable having an efficiency of length/strength in order to minimize the cable weight necessary to support itself and its attached load while withstanding drag or other externally imposed forces. The slip sleeves for use with such a tapered strength cable prevent the accidental shorting of the electrical core by one of the tapered wire ends. The cable is operative to improve the weight in water characteristic due to its tapered strength configuration. It is obviously advantageous to provide a strength capability which varies along the cable length as does the imposed tension loads in order to minimize the cable weight. The armoring and wire retention techniques of the present invention permits the varying of strength of the cable along its length by adding individual wires at predetermined points along the cable length during the armoring process. By this means, the number of armored wires at particular cross sections along the cable is varied to conform to the tensile strength requirements at that particular cross section. Additionally, the provision of the present electromechanical cable with regard to torque balancing does away with cable rotation under loaded and unloaded conditions. It should also be noted that throughout the present specification reference has been made, for purposes of simplicity, to a double tapered strength armored cable. The characteristics of such a cable may be easily extrapolated, as noted above, to a multi-layered cable having three or more contrahelically wound caged layers.

While certain changes may be made in the above-noted apparatus, without departing from the scope of the invention herein involved, it is intended that all matter contained in the above description, or shown in the accompanying drawings, shall be interpreted as illustrative and not in a limiting sense.

I claim:

1. A multiple caged tapered strength armored electrical cable of a given length, said cable comprising:

a core;

means covering said core for protecting the same;

a plurality of armored layers of wires located about said covering means, each armored layer being formed from a plurality of wires successively helically wound about the preceeding layer, the first layer being wound directly over said core, each of said plurality of wires in each layer being spaced from the adjacent two wires to form a radial space between all of said wires;

said pluralities of wires each being of given numerical quantities for a given sublength of said given cable length, said given numerical quantities being changed together progressively for progressive other given sublengths of said given cable length for producing a tapered strength caged armored cable;

means, within which loose ends of said wires in said armored layers are placed, for retaining said loose ends while permitting their movement within said retaining means and for preventing said loose ends from migrating from the armored layer in which they are initially located; and means for insulatively jacketing the multiple caged armored cable for protecting the cable, said jacketing means also filling the radial spaces located between the wires of said layers and preventing movement of one wire in any of said pluralities from appreciably moving with respect to any other wire in the same plurality of wires.

2. A double caged tapered strength armored electromechanical cable of a given length, said cable comprising:

means for conducting electricity;

means covering said electrical conducting means for electrically insulating the same;

a first armored layer of wires located about said insulating means, said first armored layer being formed from a first plurality of wires helically wound about said insulating means, each of said first plurality of wires being spaced from the adjacent two wires to form a radial space between all of said wires;

a second armored layer of wires wound upon said first armored layer, said second armored layer being formed from a second plurality of wires helically wound about said first plurality of wires, each of said second plurality of wires being spaced from each other a sufficient distance to form radial spaces between all of said second plurality of wires, said first and second pluralities of wires each being of given numerical quantities for a given sublength of said given cable length, said given numerical quantities being changed together progressively for progressive other given sublengths of said given cable length for producing a tapered strength caged armored electromechanical cable;

means, adapted to receive and movably retain the loose ends contained throughout both said first and second armored layers, for preventing said loose ends from migrating from the armored layer in which they are initially placed and shorting the electrical core of said cable; and means for insulatively jacketing the double caged armored cable for protecting the cable, said jacketing means also filling the radial spaces located between the wires of said first and second pluralities of wires and preventing one wire in either of said pluralities from appreciably moving with respect to any other wire in the same plurality of wires.

3. A double caged tapered strength armored electromechanical cable of a given length, said cable comprising:

means for conducting electricity;

means covering said electrical conducting means for electrically insulating the same;

a first armored layer of wires located about said insulating means, said first armored layer being formed from a first plurality of wires helically wound in a given direction about said insulating means, each of said first plurality of wires being spaced from the adjacent two wires to form a radial space between all of said wires;

a second armored layer of wires wound upon said first armored layer, said second armored layer being formed from a second plurality of wires helically wound about said first plurality of wires in the opposite helical winding direction for providing a torque balanced net result for the two layers, each of said second plurality of wires being spaced from each other a sufficient distance to form radial spaces between all of said second plurality of wires, said first and second pluralities of wires each being of given numerical quantities for a given sublength of said given cable length, said given numerical quantities being changed together progressively for progressive other given sublengths of said given cable length for producing a tapered strength caged armored electromechanical cable which is torque balanced in any given cable sublength;

means, adapted to receive and movably retain the loose ends contained throughout both said first and second armored layers, for preventing said loose ends from migrating from the armored layer in which they are initially placed and shorting the electrical core of said cable; and means for insulatively jacketing the double caged armored cable for protecting the cable, said jacketing means also filling the radial spaces located between the wires of said first and second pluralities of wires and preventing movement of one wire in either of said pluralities from appreciably moving with respect to any other wire in the same plurality of wires.

4. The double caged tapered strength armored electromechanical cable according to claim 3 in which said means for preventing wire end migration is a generally tubular shaped element into which individual wire ends are placed, each wire end having a separate tubular shaped element.

5. The double caged tapered strength armored electromechanical cable according to claim 3 in which said means for preventing wire end migration is a generally tubular shaped element into which individual wire ends are placed, each wire end having a separate tubular shaped element, said tubular shaped element having an inner diameter just large enough to receive a wire therein and having an outside diameter which is slightly larger than a wire diameter.

6. The double caged tapered strength armored electromechanical cable according to claim 3 in which said means for preventing wire end migration is a generally tubular shaped element into which individual wire ends are placed, each wire end having a separate tubular shaped element, said tubular element being formed from a metal.

7. The double caged tapered strength armored electromechanical cable according to claim 3 in which said means for preventing wire end migration is a generally tubular shaped element into which individual wire ends are placed, each wire end having a separate tubular shaped element, said tubular element being formed from a plastic which will retain said wire end.

8. The double caged tapered strength armored electromechanical cable according to claim 3 in which said means for preventing wire end migration is a generally tubular shaped element into which individual wire ends are placed, each wire end having a separate tubular shaped element, said tubular element being formed from a metal, said metal tubular element being spot welded to the two adjacent wires in the layer in which the wire it is associated with lies.

9. The double caged tapered strength armored electromechanical cable according to claim 3 in which said means for preventing wire end migration is a generally tubular shaped element into which individual wire ends are placed, each wire end having a separate tubular shaped element, said tubular element being formed from a plastic which will retain said wire end, said plastic tubular element being rigidly attached to the two adjacent wires in the layer in which the wire it is associated with lies.

10. A method for producing a double caged tapered strength armored electromechanical cable of a given overall length, said method comprising:

supporting an electrically conductive core;

covering said electrically conductive core along its entire length with means for insulating the same;

helically winding a first armored layer of wires in a given direction about the insulating means such that each of the wires in said first armored layer are separated from the adjacent two wires to form a radial space therebetween, the number of such wires being progressively changed for given progressive sublength of the cable's overall given length;

placing the loose ends of said changed wires in said first armored layer within protective tubular elements such that said wire ends may move therein but cannot migrate from said first armored layer with which it is associated;

helically winding a second armored layer of wires upon said first armored layer in the opposite direction from said first armored layer such that each of the wires in said second armored layer are separated from the adjacent two wires to form another radial space therebetween, the number of such wires also being progressively changed in a similar manner with said first armored wire layer for the same given progressive sublengths of the cable's overall given length for producing a torque balanced tapered strength caged armored electromechanical cable;

placing the loose ends of said changed wires in said second armored layer within protective tubular elements such that said wire ends may move therein but cannot migrate from said second armored layer with which it is associated; and jacketing the double caged armored cable with insulation which also fills the radial spaces located between the wires of said first and second cage armored layers and preventing one wire in either layer from appreciably moving with respect to any other wire in the same layer.

* * * * *

UNITED STATES PATENT AND TRADEMARK OFFICE

CERTIFICATE OF CORRECTION

PATENT NO. : 4,131,759
DATED : December 26, 1978
INVENTOR(S) : Edward M. Felkel

It is certified that error appears in the above–identified patent and that said Letters Patent are hereby corrected as shown below:

Column 1, line 20; after "total", add -- armor --.

Column 5, line 34; after "beta", add -- noted --.

Exhibit A, Section #11, Column I;"29,000" should read -- 3.125 --.

Exhibit A, Section #11, Column J; add -- 29,000 --.

Column 6, line 44; after "such", delete "as".

Column 9, line 40; after "double", add -- caged --.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*